US007104194B2

(12) United States Patent
Aoki

(10) Patent No.: US 7,104,194 B2
(45) Date of Patent: Sep. 12, 2006

(54) CYLINDER APPARATUS WITH A CIRCUMFERENTIALLY MOVABLE OPERATING MEMBER AND SWINGABLE LEVERS TO FIX AND RELEASE OPERATING MEMBER IN A SELECTED POSITION

(75) Inventor: Takanobu Aoki, Ibaraki (JP)

(73) Assignee: Komori Corporation, Tokyo (JP)

( * ) Notice: Subject to any disclaimer, the term of this patent is extended or adjusted under 35 U.S.C. 154(b) by 124 days.

(21) Appl. No.: 10/943,464

(22) Filed: Sep. 17, 2004

(65) Prior Publication Data

US 2005/0061179 A1 Mar. 24, 2005

(30) Foreign Application Priority Data

Sep. 18, 2003 (JP) ..... 2003-326925

(51) Int. Cl.
*B41F 5/02* (2006.01)
*B41F 21/10* (2006.01)

(52) U.S. Cl. ..... 101/230; 101/246

(58) Field of Classification Search ..... 101/230, 101/183, 410, 409, 246; 271/82, 277; 492/22, 492/38

See application file for complete search history.

(56) References Cited

U.S. PATENT DOCUMENTS 4,831,929 A 5/1989 Saito
5,105,737 A * 4/1992 Becker ..... 101/230
5,365,845 A * 11/1994 Becker ..... 101/230

FOREIGN PATENT DOCUMENTS

CN 1012566 B 5/1991

* cited by examiner

*Primary Examiner*—Leslie J. Evanisko
(74) *Attorney, Agent, or Firm*—Blakely Sokoloff Taylor & Zafman

(57) ABSTRACT

A cylinder apparatus includes a cylinder body, support member, shaft, coned disc spring, air cylinder, and levers. The cylinder body is rotatably supported by a pair of frames. The support member is supported to be movable in a circumferential direction with respect to the cylinder body, and supports a suction head. The shaft is supported to be movable in an axial direction of the cylinder body. The coned disc spring biases the shaft in a first direction. The air cylinder moves the shaft in a second direction opposite to the first direction against an elastic force of the coned disc spring. The levers are swingably supported by the cylinder body and swing upon movement of the shaft to fix/release the support member with respect to the cylinder body.

17 Claims, 8 Drawing Sheets

CYLINDER APPARATUS WITH A CIRCUMFERENTIALLY MOVABLE OPERATING MEMBER AND SWINGABLE LEVERS TO FIX AND RELEASE OPERATING MEMBER IN A SELECTED POSITION

BACKGROUND OF THE INVENTION

The present invention relates to a cylinder apparatus in a sheet-fed offset rotary printing press with a turn-over mechanism, for adjusting, with respect to the grippers of a double-diameter cylinder, the phase of a phase-changeable suction member which draws by suction and holds the trailing edge of a sheet gripped and conveyed by the grippers and for fixing the suction member to a cylinder body.

As shown in U.S. Pat. No. 4,831,929, a conventional cylinder apparatus for a printing press has a cylinder body having an axial hole extending through the central portion in the axial direction, a pair of left and right side plates which are in contact with the two end faces of the cylinder body and support suction heads, press rods which urge the side plates against the two end faces of the cylinder body and fix the side plates to the cylinder body, and a fixing shaft which is inserted in the axial hole of the cylinder body and moved to fix and release the side plates to and from the cylinder body with the press rods.

According to the structure of the conventional cylinder apparatus, when the fixing shaft is to be moved in the axial direction in the axial hole of the cylinder body in order to adjust the phase of a suction head with respect to the gripper, a screw member threadably engaging with the fixing shaft is pivoted manually. This operation not only poses a burden to the operator but also cannot be automatized.

SUMMARY OF THE INVENTION

It is an object of the present invention to provide a cylinder apparatus in which the burden to the operator is decreased and automatization is facilitated.

In order to achieve the above object, according to the present invention, there is provided a cylinder apparatus comprising a cylinder body rotatably supported by a pair of frames, a support mechanism which is supported to be movable in a circumferential direction with respect to the cylinder body and supports a operating member, a shaft supported to be movable in an axial direction of the cylinder body, a first elastic member which biases the shaft in a first direction, driving means for moving the shaft in a second direction opposite to the first direction against an elastic force of the first elastic member, and first and second levers which are swingably supported by the cylinder body and swing upon movement of the shaft to fix/release the support mechanism with respect to the cylinder body.

DESCRIPTION OF THE PREFERRED EMBODIMENT

A cylinder apparatus according to one embodiment of the present invention will be described with reference to FIGS. 1 to 9.

Figure 8:
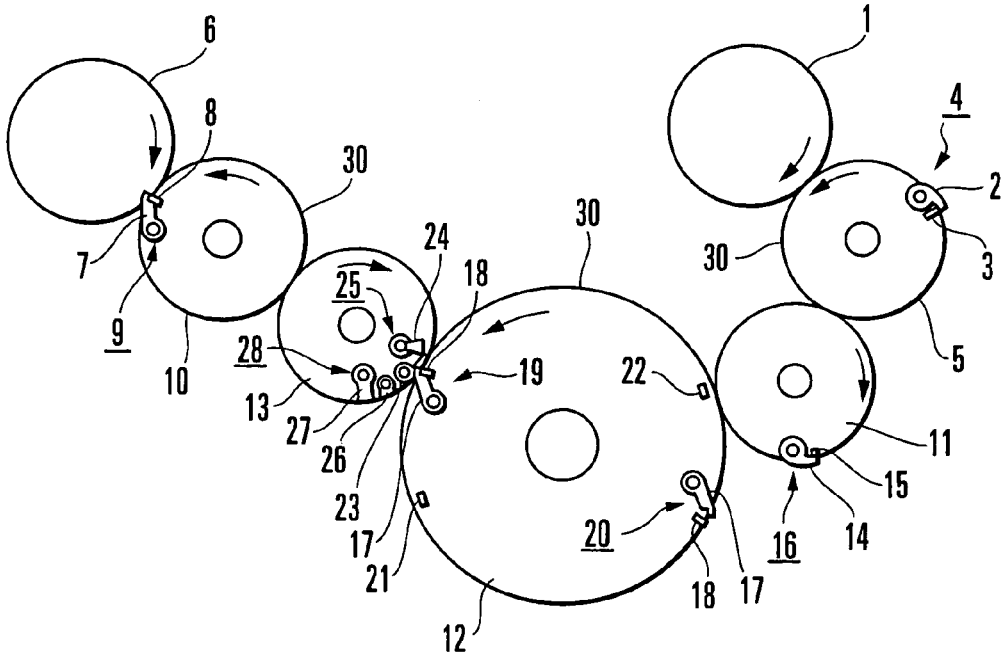
FIG. 8 is a view showing the cylinder arrangement to explain single-side printing operation in the sheet-fed offset rotary printing press with the turn-over mechanism.
Figure 9:
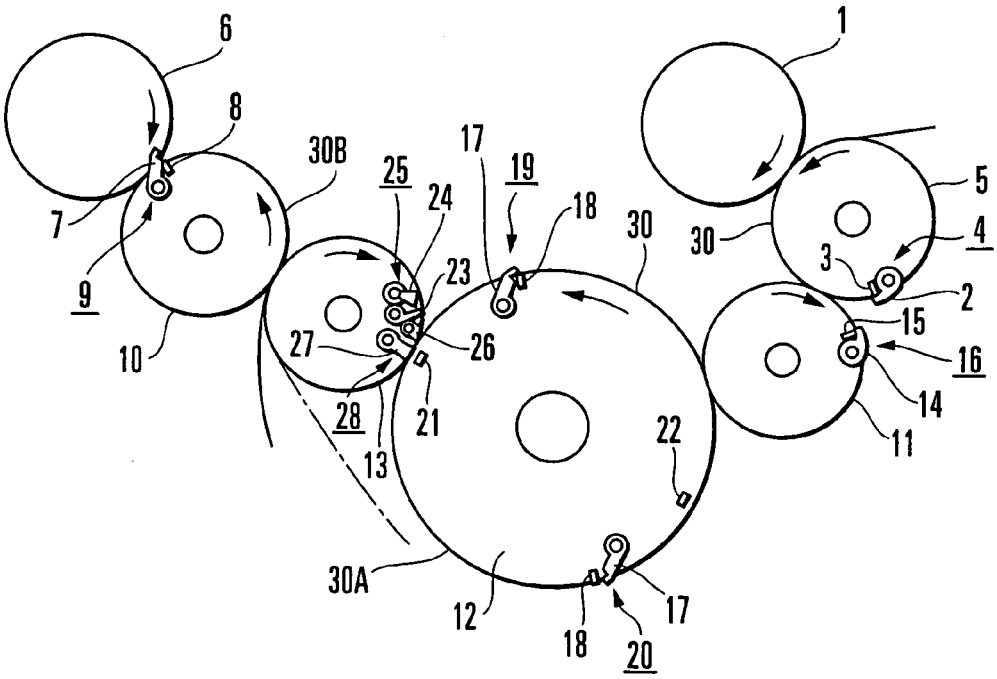
FIG. 9 is a view showing the cylinder arrangement to explain double-side printing operation in the sheet-fed offset rotary printing press with the turn-over mechanism.

First, the schematic arrangement of a printing press of this type will be described with reference to FIGS. 8 and 9. In FIG. 8, a blanket cylinder 1 is arranged below a plate cylinder (not shown) to be in contact with it. An impression cylinder 5 is arranged obliquely below the blanket cylinder 1 so that its circumferential surface is in contact with the blanket cylinder 1. The impression cylinder 5 has gripper units 4 each consisting of a gripper 2 and gripper pad 3 (to be referred to as the gripper unit 4 hereinafter) in a gap formed in the outer peripheral portion of the impression cylinder 5. In a printing unit at the downstream side, a blanket cylinder 6 contacting a plate cylinder (not shown), and an impression cylinder 10 which has gripper units 9 each consisting of a gripper 7 and gripper pad 8 (to be referred to as the gripper unit 9 hereinafter) and a circumferential surface contacting the blanket cylinder 6 are also arranged. A turn-over mechanism including a transfer cylinder 11, double-diameter cylinder 12, and turn-over cylinder 13, the circumferential surface of which are in contact with each other, is arranged between the two impression cylinders 5 and 10.

Of these cylinders, the transfer cylinder 11 includes gripper units 16 each consisting of a gripper 14 and gripper pad 15 (to be referred to as the gripper unit 16 hereinafter) in a gap formed in the outer peripheral portion of the transfer cylinder 11. The double-diameter cylinder 12 has a diameter twice that of the transfer cylinder 11 and the like. Two sets of gripper units 19 and 20 each consisting of a gripper 17 and gripper pad 18 (to be referred to as the gripper units 19 and 20 hereinafter) are arranged at positions of equal angular intervals of the outer peripheral portion of the double-diameter cylinder 12. Suction heads (suction members) 21 and 22 serving as operating members fixed by splitting and fastening to a suction pipe 41 (to be described later) are disposed at positions advancing from the gripper units 19 and 20 by a predetermined angle in the rotating direction of the cylinder.

The suction heads 21 and 22 include a plurality of suction heads that are arranged on the outer peripheral portion of the double-diameter cylinder 12 along the axial direction so as to be parallel to each other. The suction heads 21 and 22 are supported to be movable in the circumferential direction, so that a phase with respect to the gripper units 19 and 20 in the circumferential direction can be adjusted. Gripper units 25 each consisting of a gripper 23 and gripper pad 24 (to be referred to as the gripper units 25 hereinafter), and gripper units 28 each consisting of a gripper 26 and gripper pad 27 (to be referred to as the gripper units 28 hereinafter) are disposed in gaps formed in the outer peripheral portion of the turn-over cylinder 13, to be adjacent to each other in the circumferential direction. The cylinders 1, 5, 11, 12, 13, 10, and 6 are driven and coupled by gears. A stationary gear fixed to a shaft and a pivotal gear are fixed to one end shaft of the turn-over cylinder 13 of these cylinders such that the stationary and pivotal gears can be fixed and released. The stationary gear meshes with the gear of the impression cylinder 10. The pivotal gear meshes with the gear of the double-diameter cylinder 12.

With this embodiment, in the case of single-side printing shown in FIG. 8, when the respective cylinders rotate in directions indicated by arrows, a sheet 30 which is fed from a paper sheet feeder (not shown) and gripped by the gripper units 4 of the impression cylinder 5 through swing units (not shown), is then gripped and conveyed by the gripper units 16 of the transfer cylinder 11. When the sheet 30 passes between the blanket cylinder 1 and impression cylinder 5, an image of the first color is printed on its surface. The sheet 30 is then gripped and conveyed by the gripper units 19 (20) of the double-diameter cylinder 12 from the gripper units 16 of the transfer cylinder 11. When the gripper units 19 and 25 oppose each other, as shown in FIG. 8, the sheet 30 is then gripped and conveyed by the gripper units 25 from the gripper units 19. After this, the sheet 30 is gripped and conveyed by the gripper units 9 of the impression cylinder 10. When the sheet 30 passes between the blanket cylinder 6 and impression cylinder 10, an image of the second color is printed on the same surface on which the image of the first color has been printed.

When the single-side printing mode is to be switched to the double-side printing mode, the pivotal gear is pivoted from a state wherein the gripper units 19 and 25 oppose each other (FIG. 8), so that the suction heads 21 and gripper units 28 oppose each other. Thus, the phase of the upstream-side cylinder group including the double-diameter cylinder 12 is adjusted with respect to the turn-over cylinder 13. Also, the phase of the gripper units 19 and 20 of the double-diameter cylinder 12 relative to the suction heads 21 and 22 is adjusted, thereby coping with a change in sheet size. The positions at which the gripper units 19 and 20 of the double-diameter cylinder 12 release the leading edge of the sheet 30 change between the single- and double-side printing modes almost by the length in the convey direction of the sheet 30. Accordingly, the actuating position of a sheet release cam (not shown) is adjusted.

When the respective cylinders are rotated after the switching adjustment is performed in this manner, the sheet 30 subjected to printing on a front surface, in the same manner as in single-side printing, is conveyed while being gripped by the gripper units 19 (20) of the double-diameter cylinder 12 and drawn by suction at its trailing edge by the suction heads 21 (22). The sheet 30 is conveyed until its trailing edge reaches the contacting point between the two cylinders 12 and 13, as indicated by reference numeral 30A. At this time, the trailing edge of the sheet 30A is gripped upon opening/closing of the gripper units 28 and suction/release of the suction heads 21. Simultaneously, the gripper unit 20 releases the leading edge of the sheet 30A. Then, the sheet 30A is conveyed by the turn-over cylinder 13 while forwarding the trailing edge side.

During the conveyance, both the gripper units 25 and 28 instantaneously open and close at different timings, and the sheet 30A is gripped by the gripper units 25 from the gripper units 28, and is conveyed. When the gripper units 25 and the gripper units 9 of the impression cylinder 10 oppose each other, the sheet 30A is gripped by the gripper units 9, and is conveyed as indicated by reference numeral 30B. When the sheet 30B passes between the blanket cylinder 6 and impression cylinder 10, its rear surface is in contact with the blanket cylinder 6, so that the rear surface is subjected to printing. In this manner, the sheet 30B is double-side printed because of previous front-surface printing and current rear-surface printing, and is delivered.

Figure 5:
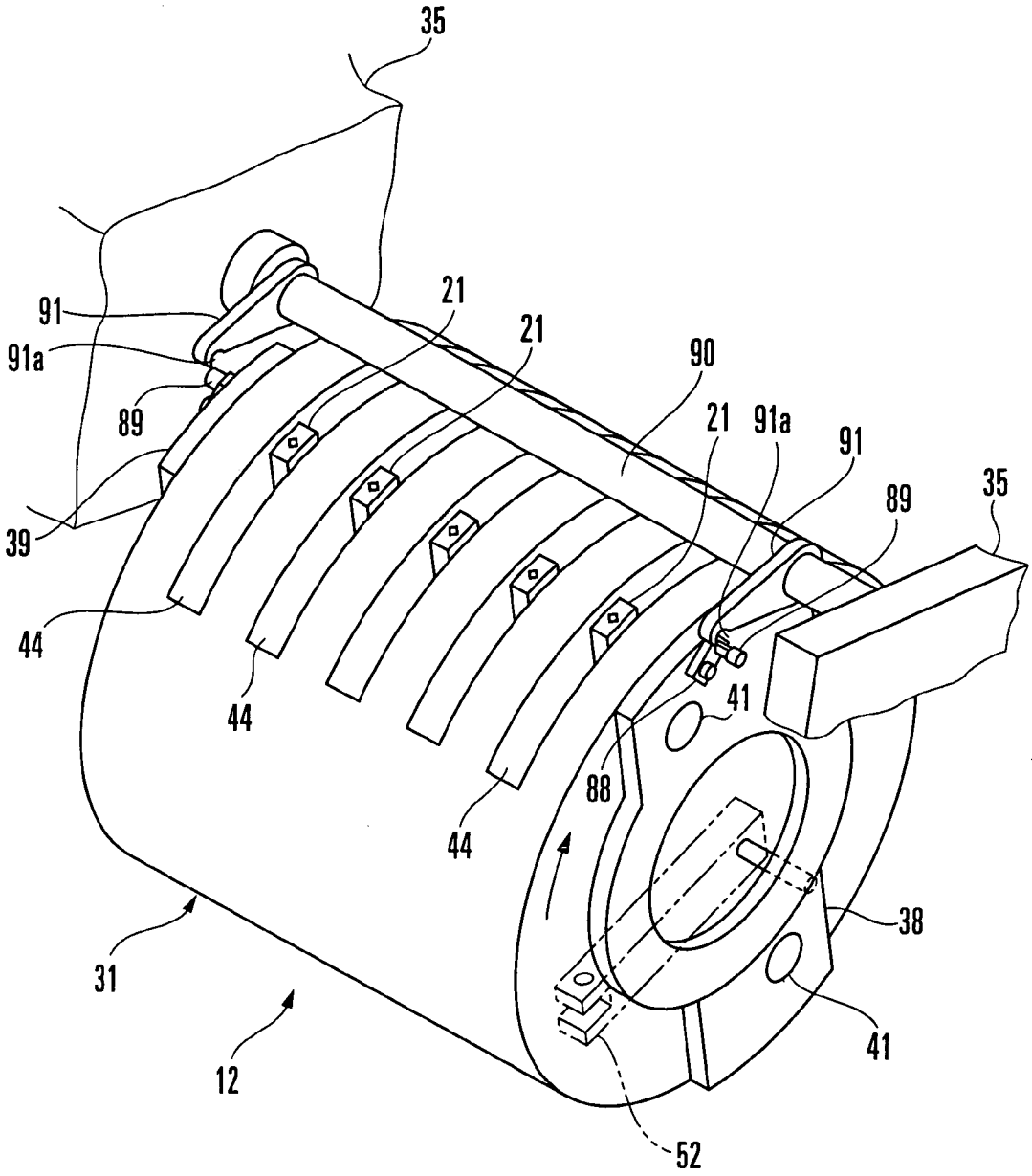
FIG. 5 is a perspective view showing the outer appearance of the double-diameter cylinder shown in FIGS. 1 and 2.

In the three-roller-type sheet-fed offset rotary printing press with the turn-over mechanism which operates in this manner, the gripper units 19 and 20 for gripping the leading edge of the sheet 30 and the suction heads 21 and 22 for chucking the trailing edge of the sheet 30 are provided to the double-diameter cylinder 12, as described above. The phase in the circumferential direction between the gripper units 19 and suction heads 21 and between the gripper units 20 and suction heads 22 must be adjusted when the printing mode between the single- and double-side printing modes or when the sheet size is to be changed. More specifically, as shown in FIG. 5, a plurality of grooves 44 extending in the circumferential direction are formed in the circumferential surface of a cylinder body 31 of the double-diameter cylinder 12 to be parallel to each other at predetermined spaces from each other in the axial direction. The suction heads 21 supported by the cylinder body 31 are engaged in the corresponding grooves 44. The suction heads 21 are moved in the circumferential direction in the grooves 44, thereby adjusting the phase, and are fixed. This suction member phase adjusting operation will be described below.

Figure 1:
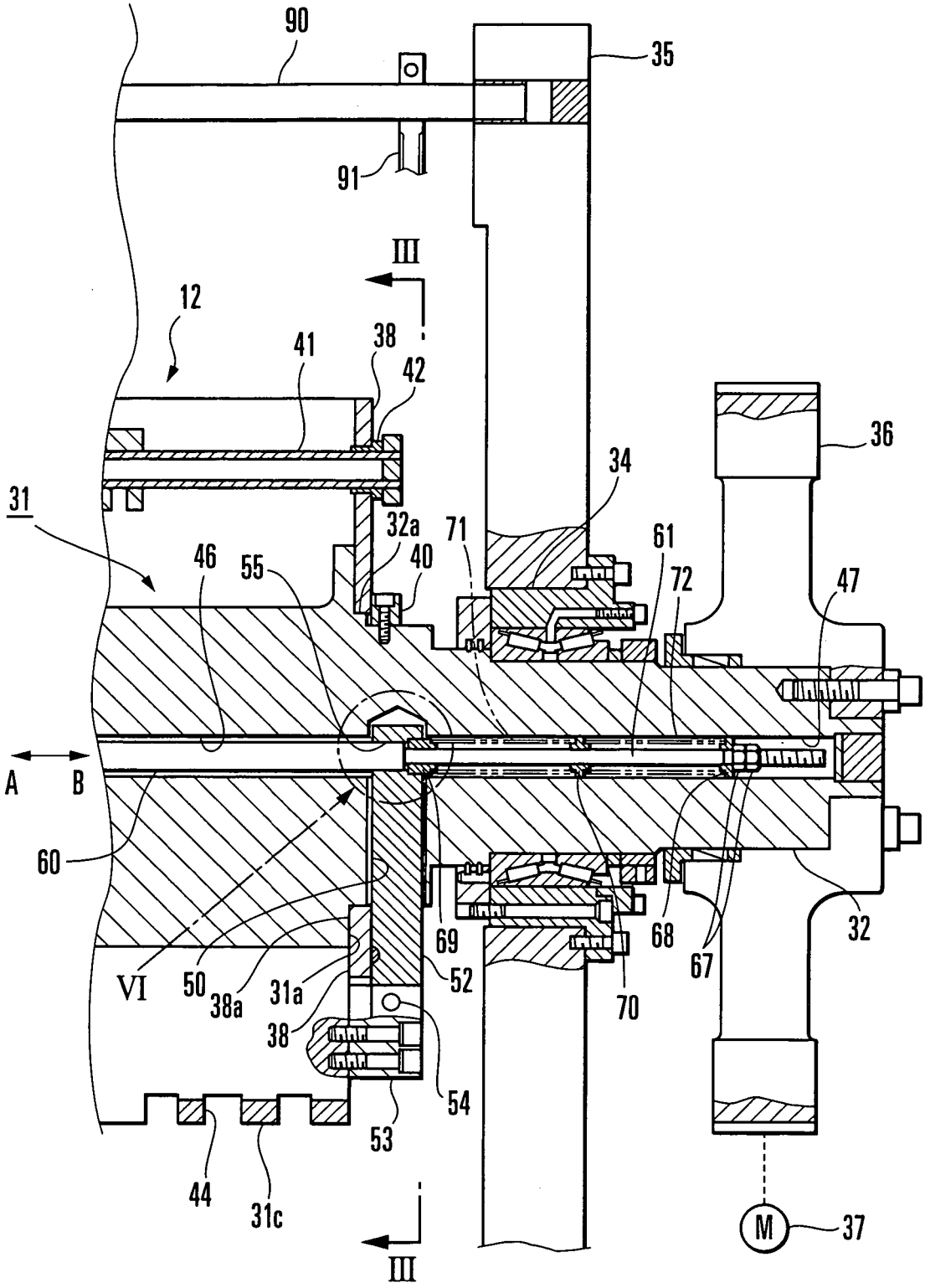
FIG. 1 is a longitudinal sectional view showing the right half of a double-diameter cylinder in a sheet-fed offset rotary printing press with a turn-over mechanism according to one embodiment of the present invention.
Figure 2:
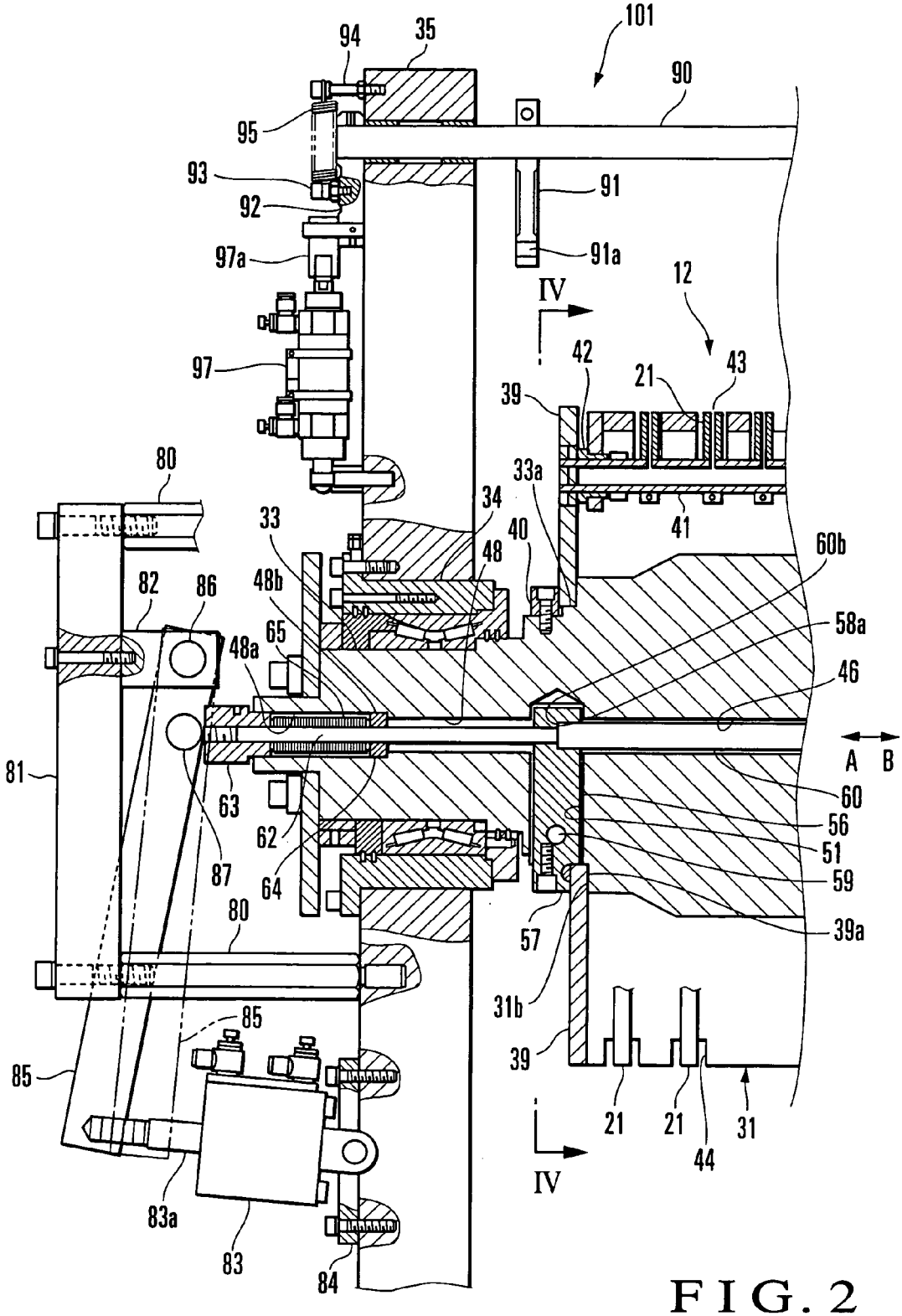
FIG. 2 is a longitudinal sectional view showing the left half of the double-diameter cylinder shown in FIG. 1.

Referring to FIGS. 1 and 2, the double-diameter cylinder 12 has the columnar cylinder body 31 having a cast hollow portion, and end shafts 32 and 33 which are integrally formed with the cylinder body 31 and projecting from the two ends of the cylinder body 31. The two end shafts 32 and 33 are pivotally, axially supported, at positions close to end faces 31*a* and 31*b* of the cylinder body 31, by a pair of frames 35 through roll bearings 34. A double-diameter cylinder gear 36 which meshes with the pivotal gear of the turn-over cylinder 13 is fixed to the end of the end shaft 32 projecting from the frame 35. The double-diameter cylinder gear 36 is driven by a printing press motor 37. The pivotal gear is fixed to an adjacent stationary gear of the turn-over cylinder 13 to transmit rotation. When the stationary gear and pivotal gear are disengaged, phase adjustment between the turn-over cylinder 13 and double-diameter cylinder 12 can be performed.

First and second support members 38 and 39 are pivotally fixed on large-diameter portions 32*a* and 33*a* of the two end shafts 32 and 33, respectively. The first and second support members 38 and 39 include O-shaped ring portions 38*b* and 39*b* and two arm portions 38*c* and 39*c* projecting from the ring portions 38*b* and 39*b* outwardly at an angular interval of 180°. The first and second support members 38 and 39 are regulated from moving inwardly as they abut against the end faces of the cylinder body 31, and from being removed outwardly by removal preventive members 40 fixed to the end shafts 32 and 33. The first and second pivotal support members 38 and 39 are fixed to the cylinder body 31 with fixing devices (to be described later). Suction pipes 41 are pivotally, axially supported by the arm portions 38*c* and 39*c* of the first and second support members 38 and 39 through bearings 42. Air in the suction pipes 41 is drawn by the pivotal motion of the double-diameter cylinder 12 only at a predetermined timing.

As shown in FIG. 2, the plurality of suction heads 21 respectively having suction ports 43 communicating with the suction pipes 41 are arrayed in a row in the axial direction of the double-diameter cylinder 12, and are fixed to the cylinder by splitting and fastening. The suction ports 43 are formed in the circumferential surface of the cylinder body 31. The suction heads 21 are engaged in the corresponding grooves 44 extending by a predetermined angle in the circumferential direction in an outer peripheral portion 31*c* of the cylinder body 31. The first and second support members 38 and 39 are disengaged from the cylinder body 31, and are pivoted, so that the phase in the circumferential direction between the gripper unit 19 and suction heads 21 and that between the gripper unit 20 and suction heads 22 are adjusted.

Suction member fixing operation of fixing the phase-adjusted suction heads 21 and 22, after phase adjustment, to the cylinder body 31 through the first and second support members 38 and 39 will be described.

Axial holes 46, 47, and 48 are formed at the central portion of the cylinder body 31 and at the central portions of the two end shafts 32 and 33, respectively, such that the axial holes 46, 47, and 48 extend between the two end shafts 32 and 33. A large-diameter portion 48*a* is formed on the end side of the axial hole 48, and a step 48*b* is formed at the boundary at the center of the large-diameter portion 48*a*. First and second lever storing holes 50 and 51 are respectively formed at those portions of the two end shafts 32 and 33 which are to be connected to the cylinder body 31. The first and second lever storing holes 50 and 51 are recessed from the circumferential surfaces of the two end shafts 32 and 33, respectively, in the radial direction. The distal end sides (bottom portion sides) of the lever storing holes 50 and 51 intersect with the axial holes 46, 47, and 48 perpendicularly.

As shown in FIG. 1, a substantially prismatic first lever 52 to be loosely inserted in the first lever storing hole 50 is swingably supported with its one end by a swing shaft 54 extending perpendicularly from a support block 53 fixed to the end face of the cylinder body 31. A through hole 55, the diameter of which changes between its two opening sides, is formed in the other end of the first lever 52, and a step 55*a* is formed at the central portion of the through hole 55.

As shown in FIG. 2, a press block 57 is attached to one end of a substantially prismatic second lever 56 loosely inserted in the second lever storing hole 51. A through hole 58, the diameter of which changes between its two opening sides, is formed in the other end of the second lever 56, and a step 58*a* is formed at the central portion of the through hole 58. The second lever 56 is swingably supported by a swing shaft 59 fixed to the end shaft 33 so as to extend across the second lever storing hole 51.

A shaft 60 extends through the through holes 55 and 58 of the first and second levers 52 and 56, respectively, and is inserted in the axial hole 46 of the cylinder body 31 and the axial holes 47 and 48 of the end shafts 32 and 33. The shaft 60 has first and second small-diameter portions 61 and 62 at its two ends, and steps 60*a* and 60*b* at its boundaries with the first and second small-diameter portions 61 and 62, respectively. Threaded portions are formed on the two ends of each of the first and second small-diameter portions 61 and 62.

As shown in FIG. 2, a fixing element 63 threadably engages with the end of the second small-diameter portion 62 of the shaft 60, and a coned disc spring 65 serving as the first elastic member is elastically mounted between the fixing element 63 and an engaging element 64 engaging with the step 48*b* of the axial hole 48. The shaft 60 is biased in a direction of an arrow A (toward the end shaft 33) by the spring force of the coned disc spring 65 through the fixing element 63. As shown in FIG. 1, a double nut 67 threadably engages with the end of the first small-diameter portion 61 of the shaft 60. Compression coil springs 71 and 72 serving as the second elastic member are elastically mounted between a first spring bearing member 68 engaging with the double nut 67 and a second spring bearing member 69 engaging with the step 60*a* of the shaft 60, through a third spring bearing member 70. The second spring bearing member 69 is biased in the direction of the arrow A (toward the first lever 52) by the spring forces of the compression coil springs 71 and 72. The spring forces of the compression coil springs 71 and 72 are set smaller than that of the coned disc spring 65.

Figure 6A:
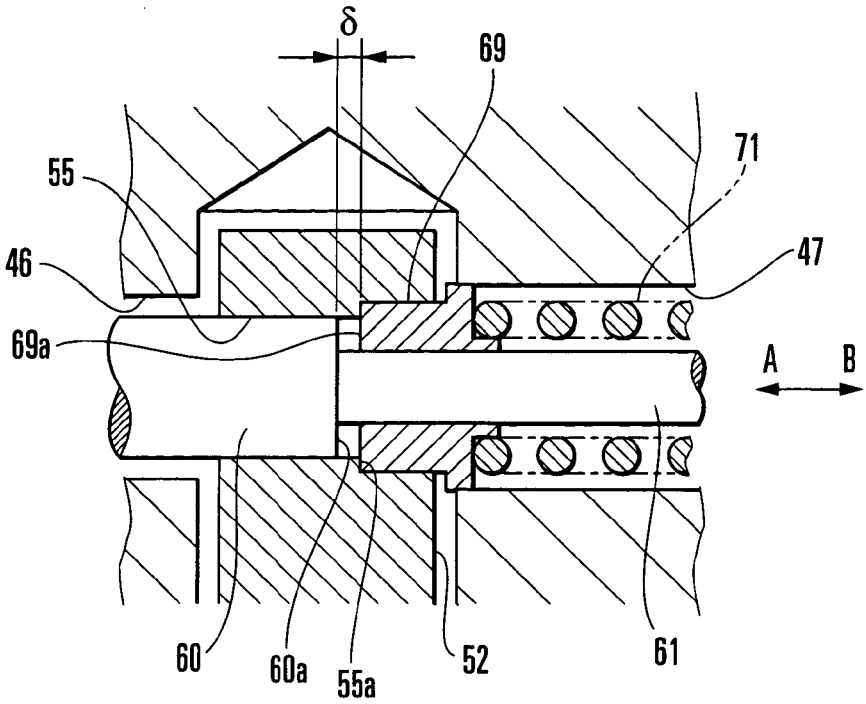
FIGS. 6A and 6B are enlarged views of a portion VI of FIG. 1 respectively showing a state wherein a support member is fixed to a cylinder body with a first lever member and a state wherein the support member is released from the cylinder body.

In this arrangement, the shaft 60 is biased in the direction of the arrow A by the spring force of the coned disc spring 65. The step 60*b* of the shaft 60 engages with the step 58*a* of the axial hole 58 of the second lever 56, and the second lever 56 swings counterclockwise in FIG. 2 about the swing shaft 59 as the swing center. The press block 57 integrally fixed to the second lever 56 presses the third support member 39. Accordingly, an end face 39*a* of the second support member 39 presses the end face 31*b* of the cylinder body 31, so that the second support member 39 is fixed to the cylinder body 31. Simultaneously, the shaft 60 moves slightly in the direction of the arrow A. As shown in FIG. 6A, the bottom surface 69*a* of the second spring bearing member 69 is disengaged from the step 60*a* of the shaft 60, and engages with the step 55*a* of the axial hole 55 of the second lever 52.

The first lever 52 is biased by the spring forces of the compression coil springs 71 and 72 through the second spring bearing member 69, and pivots counterclockwise in FIG. 1 about the swing shaft 54 as the swing center. When the first lever 52 pivots, an end face 38*a* of the first support member 38 is pressed by the end face 31*a* of the cylinder body 31, and the first support member 38 is fixed to the cylinder body 31. More specifically, when the shaft 60 is slightly moved in the direction of the arrow A by the spring force of the coned disc spring 65, the first and second support members 38 and 39 are fixed to the cylinder body 31 through the first and second levers 52 and 56. Thus, the suction heads 21 and 22 are fixed to the double-diameter cylinder 12 through the support members 38 and 39.

In this manner, when the first and second support members 38 and 39 are to be fixed to the cylinder body 31, the first and second levers 52 and 56 are biased by the compression coil springs 71 and 72 and coned disc spring 65 in a shared manner. Thus, the first and second support members 38 and 39 can be reliably fixed to the cylinder body 31 with the first and second levers 52 and 56.

Figure 7B:
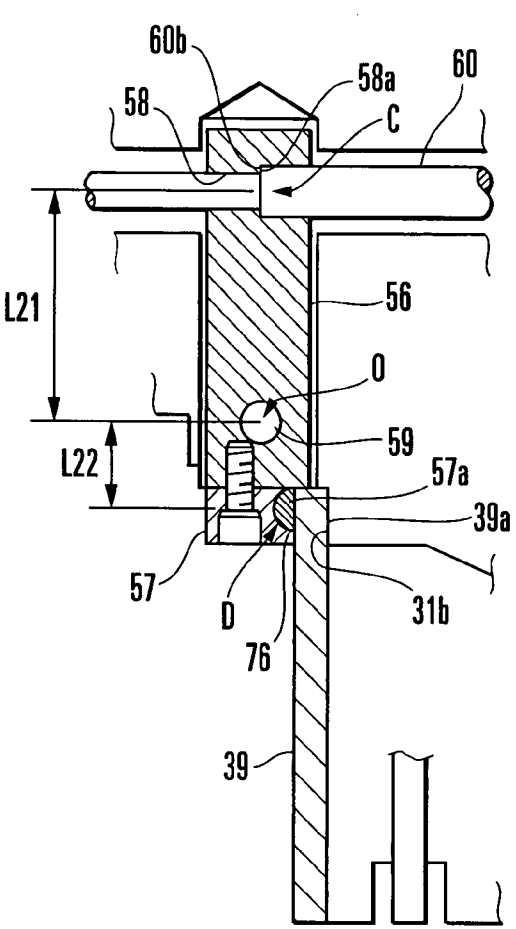
FIG. 7B is an enlarged view of a first lever.
Figure 7A:
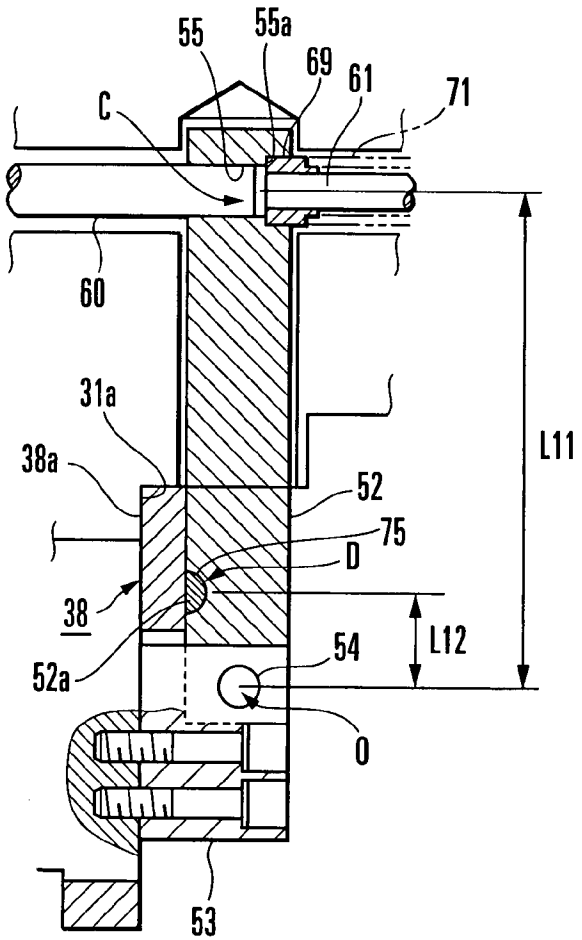
FIG. 7A is an enlarged view of a second lever.

In addition, as shown in FIGS. 7A and 7B, surface pressure adjusting members 75 and 76 each having a semi-elliptic section are interposed between the first lever 52 and first support member 38 and between the press block 57 integrally fixed to the second lever 56 and the second support member 39. The first lever 52 and press block 57 have notches 52*a* and 57*a* to be engaged by the surface pressure adjusting members 75 and 76, respectively. The notch 57*a* can be formed in the second support member 39. Even if the first and second levers 52 and 56 flex due to the surface pressures, the flexure is absorbed by the arcuate surfaces of the surface pressure adjusting members 75 and 76, so that the surface pressures are maintained at constant values.

The first and second levers 52 and 56 respectively press and fix the first and second support members 38 and 39 to the two end faces of the cylinder body 31 by the leverage. More specifically, as shown in FIG. 7A, assuming that the fulcrum of the swing shaft 54 of the first lever 52 is denoted by O, that the power point where the second spring bearing member 69 applies a force to the first lever 52 is denoted by C, and that the acting point where the first lever 52 acts on the first support member 38 through the surface pressure adjusting member 75 is denoted by D, a distance L12 between the fulcrum O and acting point D is set smaller than a distance L11 between the fulcrum O and power point C. Hence, the force of the second spring bearing member 69 generated by the elastic forces of the compression coil springs 71 and 72 and applied to the first lever 52 at the power point C is amplified at the acting point D, and the first lever 52 presses the first support member 38.

Similarly, as shown in FIG. 7B, assuming that the fulcrum of the swing shaft 59 of the second lever 56 is denoted by O, that the power point where the step 60*b* of the shaft 60 applies a force to the second lever 56 is denoted by C, and that the acting point where the second lever 56 acts on the second support member 39 through the surface pressure adjusting member 76 is denoted by D, a distance L22 between the fulcrum O and acting point D is set smaller than a distance L21 between the fulcrum O and power point C. Hence, the force of the step 60*b* of the shaft 60 generated by the elastic force of the coned disc spring 65 and applied to the second lever 56 is amplified at the acting point D, and the second lever 56 presses the second support member 39.

Consequently, the spring forces of the compression coil springs 71 and 72 and the spring force of the coned disc spring 65 can be decreased.

The leverage L11/L12 of the first lever 52 is set larger than the leverage L21/L22 of the second lever 56. As described above, since the spring forces of the compression coil springs 71 and 72 are set smaller than the spring force of the coned disc spring 65, the pressing force of the first lever 52 against the first support member 38 and the pressing force of the second lever 56 against the second support member 39 are set almost equal to each other as a whole. Accordingly, the pressing force of the first support member 38 and that of the second support member 39 at the two ends of the cylinder body 31 become equal to each other.

Suction member releasing operation which enables the first and second support members 38 and 39 to move with respect to the cylinder body 31, so that the suction heads 21 and 22 can be phase-adjusted, will be described.

Referring to FIG. 2, a plurality of studs 80 extend perpendicularly from one frame 35, and a support plate 81 is fixed to the distal ends of the studs 80 to be parallel to the frame 35. A support piece 82 is attached inside the support plate 81. A first air cylinder 83 serving as the driving device has a working rod 83*a* which can move forward/backward, and is pivotally mounted on a support base 84 fixed to the frame 35. One end of a driving bar 85 is pivotally supported by a shaft 86 projecting from the support piece 82 of the support plate 81, and its other end is pivotally mounted on the working rod 83*a*. A wheel 87 to come into contact with the fixing element 63 is pivotally supported by the driving bar 85.

In this arrangement, when the working rod 83*a* of the first air cylinder 83 moves backward, the driving bar 85 pivots counterclockwise as indicated by an alternate long and two short dashed line about the shaft 86 as the pivot center. As the driving bar 85 pivots, the wheel 87 presses the fixing element 63, and the shaft 60 moves slightly in a direction of an arrow B as the second direction against the spring force of the coned disc spring 65. Thus, in FIG. 7B, the step 60*b* of the shaft 60 and the step 58*a* of the axial hole 58 of the second lever 56 disengage from each other, and the second support member 39 pressed by the second lever 56 against the end face of the cylinder body 31 is released. Consequently, the second support member 39 is released from the cylinder body 31.

Figure 6B:
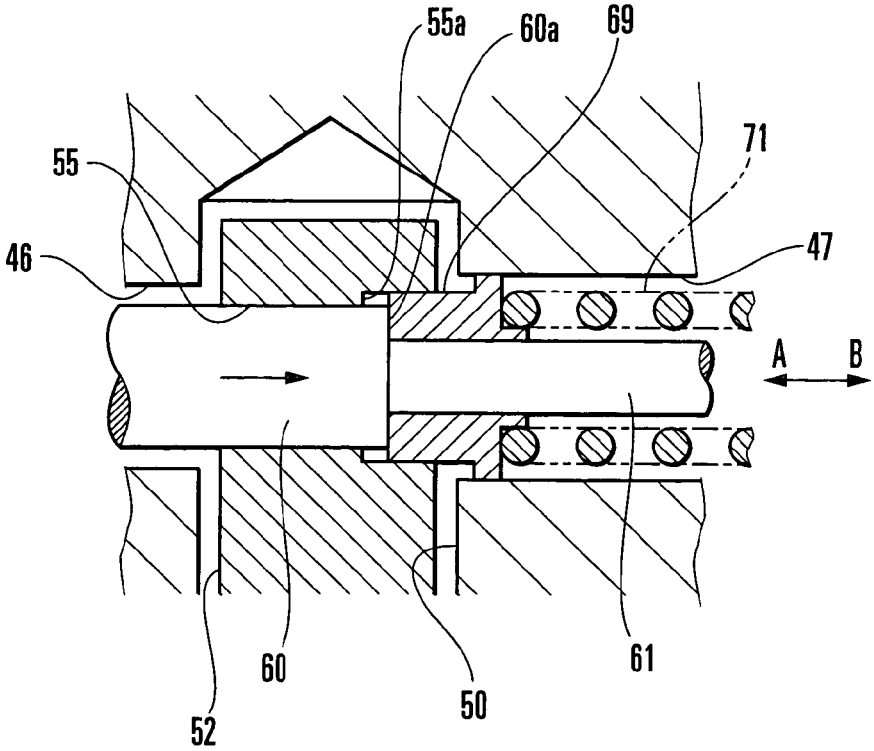

Simultaneously, as the shaft 60 moves in the direction of the arrow B, its step 60*a* engages with the bottom surface 69*a* of the second spring bearing member 69, as shown in FIG. 6B, and the second spring bearing member 69 moves slightly in the direction of the arrow B against the spring forces of the compression coil springs 71 and 72. Hence, the second spring bearing member 69 and the step 55*a* of the axial hole 55 of the first lever 52 disengage from each other, and the first support member 38 pressed by the first lever 52 against the end of the cylinder body 31 is released. Consequently, the first support member 38 is released from the cylinder body 31.

According to this embodiment, the spring forces of the coned disc spring 65 and compression coil springs 71 and 72 can be decreased, and the driving bar 85 uses leverage. Hence, the driving force of the first air cylinder 83 can be decreased, so that the first air cylinder 83 can be downsized.

Figure 3:
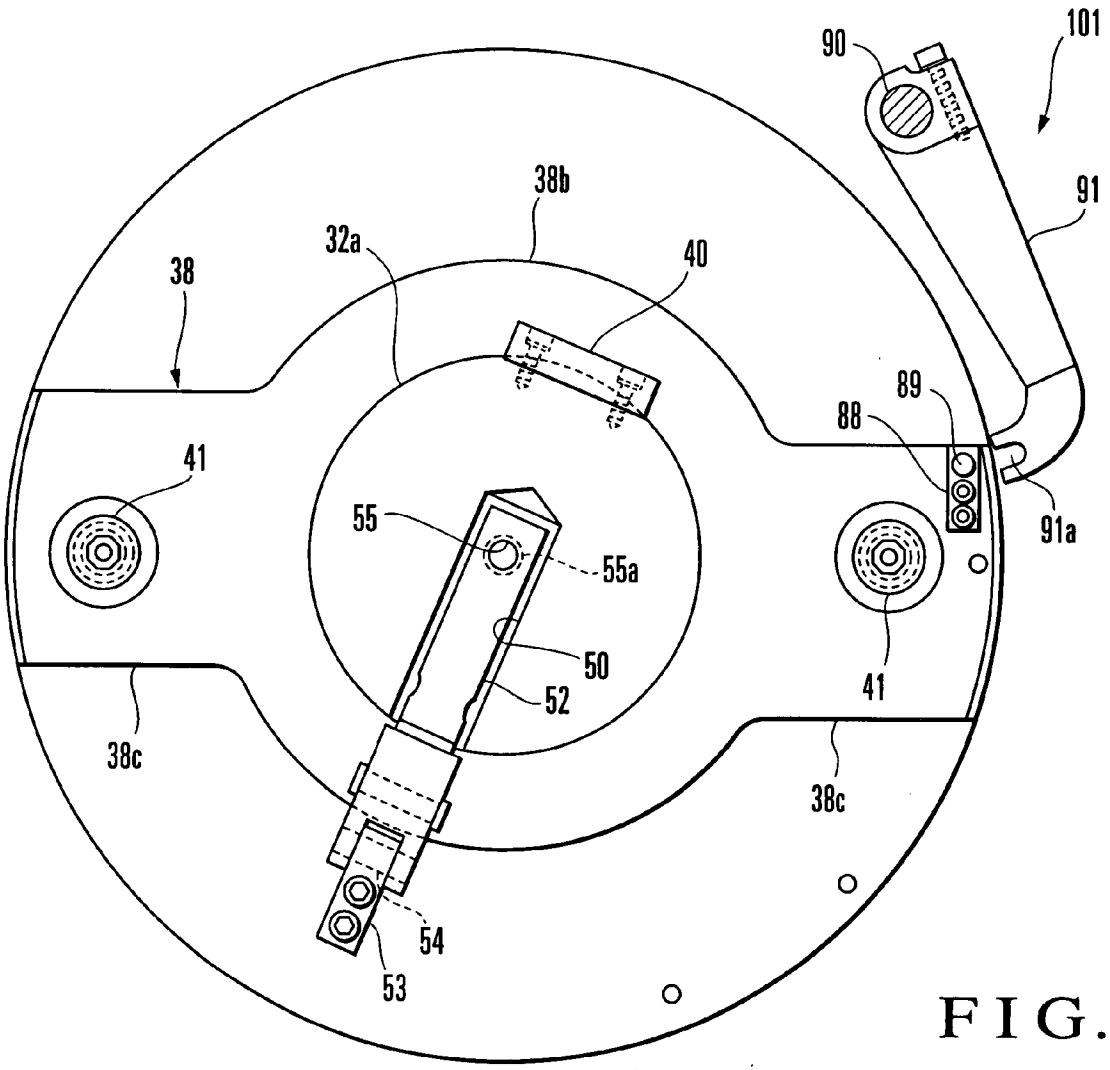
FIG. 3 is a sectional view taken along the line III—III of FIG. 1.
Figure 4:
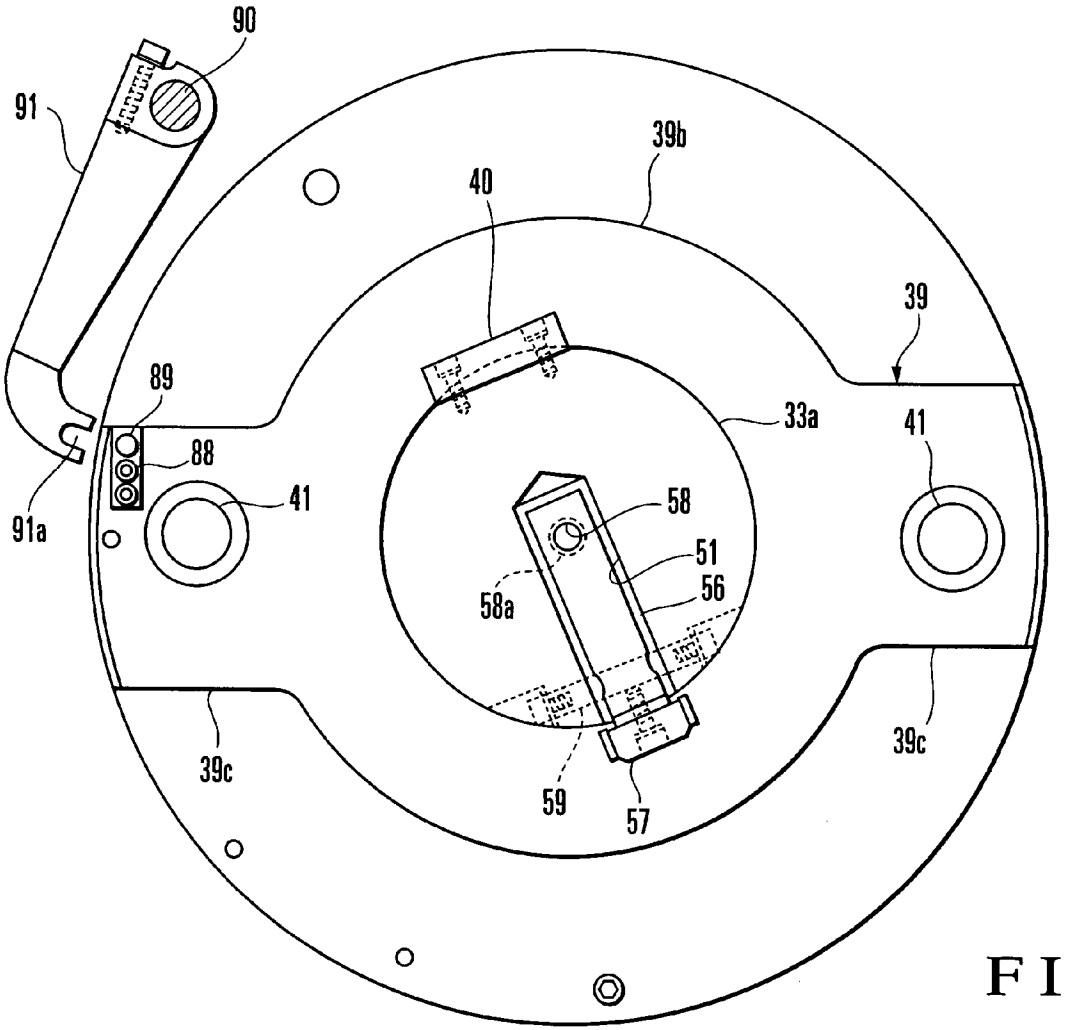
FIG. 4 is a sectional view taken along the line IV—IV of FIG. 2.

Referring to FIGS. 3 and 4, support blocks 88, from each of which an engaging pin 89 extends perpendicularly, are fixed to one arm portion 38*c* of the first support member 38 and to one arm portion 39*c* of the second support member 39, respectively. A pair of hook members 91 are axially mounted on a pivotal shaft 90 pivotally supported between the pair of frames 35, such that the hook members 91 are close to the frames 35. A U-shaped groove 91*a* to engage with the corresponding engaging pin 89 is formed in the distal end of each hook member 91. As shown in FIG. 2, one end of the pivotal shaft 90 projects outwardly from the frame 35, and one end of a lever 92 is axially mounted on this projecting end. A tensile coil spring 95 is hooked between a pin 93 extending perpendicularly from the other end of the lever 92 and the pin 94 extending perpendicularly from the frame 35. The pivotal shaft 90 is biased counterclockwise in FIG. 3 (clockwise in FIG. 4) by the tensile force of the tensile coil spring 95. Normally, the U-shaped groove 91*a* of the hook member 91 and the pin 89 are disengaged from each other by the tensile coil spring 95.

A second air cylinder 97, the cylinder end of which is pivotally mounted on one frame 35, has a working rod 97*a* which is pivotally mounted on the other end of the lever 92 and can move forward/backward. When the working rod 97*a* of the second air cylinder 97 moves forward, the pivotal shaft 90 pivots clockwise in FIG. 3 (counterclockwise in FIG. 4) through the lever 92, and the U-shaped grooves 91*a* of the hook members 91 engage with the pins 89. In this state, pivot motion of the first and second support members 38 and 39 is regulated. The second air cylinder 97, pivotal shaft 90, hook member 91, U-shaped groove 91*a*, and pin 89 form a pivot regulating mechanism 101.

In this arrangement, when the sheet size is changed and accordingly the rotational phase of the suction heads 21 and 22 with respect to the gripper units 19 and 20 of the double-diameter cylinder 12 is to be changed, first, the double-diameter cylinder 12 is pivoted to a predetermined position. Subsequently, the working rod 97*a* of the second air cylinder 97 moves forward to pivot the pivotal shaft 90 clockwise in FIG. 3 (counterclockwise in FIG. 4). The U-shaped grooves 91*a* of the hook members 91 engage with the pins 89, to regulate the pivot motion of the first and second support members 38 and 39. The working rod 83*a* of the first air cylinder 83 then moves backward, to pivot the driving bar 85 counterclockwise in FIG. 2 about the shaft 86 as the pivot center as indicated by an alternate long and two short dashed line. The wheel 87 presses the fixing element 63, and the shaft 60 moves slightly in the direction of the arrow B against the spring fore of the coned disc spring 65. As the shaft 60 moves, the first and second support members 38 and 39 are released from the cylinder body 31.

In this state, the printing press motor 37 is driven, so that the double-diameter cylinder gear 36 is pivoted through a predetermined pivot angle, and the cylinder body 31 is also pivoted together with the double-diameter cylinder gear 36 through the predetermined angle. Simultaneously, the gripper units 19 and 20 of the cylinder body 31 also pivot integrally, so that the rotational phase of the suction heads 21 and 22 supported by the first and second support members 38 and 39 with respect to the gripper units 19 and 20 is changed.

In this state, when the first air cylinder 83 is driven, the first and second support members 38 and 39 can be fixed to and released from the cylinder body 31. Hence, when compared to the conventional apparatus, the burden to the operator can be decreased and the operation can be automatized.

When the working rod 83*a* of the first air cylinder 83 moves forward and the driving bar 85 pivots clockwise to the position indicated by a solid line in FIG. 2 about the shaft 86 as the pivot center, the wheel 87 which has been pressing the fixing element 63 is released. The fixing element 63 is moved in the direction of the arrow A together with the shaft 60 by the spring force of the coned disc spring 65, and the first and second support members 38 and 39 are fixed to the two end faces of the cylinder body 31 by the first and second levers 52 and 56. At this time, the wheel 87 is separate from the fixing element 63. Thus, the wheel 87 and fixing element 63 will not wear in the subsequent printing.

After the rotational phase of the suction heads 21 and 22 is changed, when the working rod 97*a* of the second air cylinder 97 moves backward, the pivotal shaft 90 pivots counterclockwise in FIG. 3 (clockwise in FIG. 4). The U-shaped grooves 91*a* of the hook members 91 and the pins 89 are disengaged from each other, so that the first and second support members 38 and 39 become pivotal.

In this embodiment, the cylinder of the printing press has been described. The present invention can also be applied to adjustment of the phase between a gripper and suction head in a coater apparatus which coats the two surfaces of a sheet. A case has been described wherein the phase between the gripper and the suction head as a operating member is to be adjusted. The present invention can also be applied to adjustment of a phase between a pin in the folding cylinder of a folding machine and a knife as a operating member, or to adjustment of a phase between a pin as a operating member and a knife.

As has been described above, according to the present invention, the burden to the operator can be decreased and the operation can be automatized. Since the support member is fixed to the cylinder body by using the leverage, the spring force of the first elastic member can be decreased, and accordingly the driving device can be downsized. When fixing the support member to the cylinder body, the two levers are biased by the first and second elastic members in a shared manner. Thus, the support member can be fixed to the cylinder body with the two levers reliably. Also, wear of the driving device during printing operation can be prevented.

What is claimed is:

1. A cylinder apparatus comprising:

a cylinder body rotatably supported by a pair of frames;

a support mechanism which is supported to be movable in a circumferential direction with respect to said cylinder body and supports an operating member;

a shaft supported to be movable in an axial direction of said cylinder body;

a first elastic member which biases said shaft in a first direction;

driving means for moving said shaft in a second direction opposite to the first direction against an elastic force of said first elastic member; and first and second levers which are swingably supported by said cylinder body and swing upon movement of said shaft to fix/release said support mechanism with respect to said cylinder body.

2. An apparatus according to claim 1, wherein when said shaft moves in the first direction, said support mechanism is fixed to said cylinder body by pressing forces of said first and second levers, and when said shaft moves in the second direction opposite to the first direction, pressing forces of said first and second levers are released and said support mechanism is released from said cylinder body.

3. An apparatus according to claim 2, further comprising a pivot regulating mechanism which regulates pivot motion of said support mechanism accompanying pivot motion of said cylinder body when said support mechanism is released from said cylinder body.

4. An apparatus according to claim 1, wherein said support mechanism further includes first and second support members located on two end sides of said cylinder body, and said operating member is supported by said first and second support members.

5. An apparatus according to claim 4, wherein said support mechanism further includes a suction pipe which lies between said first and second support members so as to extend in said cylinder body in the axial direction, and supports said operating member.

6. An apparatus according to claim 4, wherein when said first lever swings in the first direction, said first support member presses said cylinder body so that said first support member is fixed to said cylinder body, and when said second lever swings in the first direction, said second support member presses said cylinder body so that said second support member is fixed to said cylinder body.

7. An apparatus according to claim 6, wherein end faces of said first and second support members abut against first end face and second end face, respectively, of said cylinder body, so that said operating member is fixed to said cylinder body.

8. An apparatus according to claim 7, wherein said first support member is arranged between one of the end faces of said cylinder body and said first lever, said second support member is arranged between the other of the end faces of said cylinder body and said second lever, and when said first and second levers press said first and second support members, said first and second support members are fixed to said cylinder body.

9. An apparatus according to claim 6, wherein said first and second levers each have a swingably supported fulcrum, a power point which is pressed in response to movement of said shaft, and an acting point which presses said first and second support members, the acting point of said first support member being located between the fulcrum and power point, and the fulcrum of said second support member being located between the power point and acting point.

10. An apparatus according to claim 9, wherein $$L11/L12>L21/L22$$

is set where, in said first lever, L11 is a length between the fulcrum and power point and L12 is a length between the fulcrum and acting point and, in said second lever, L21 is a length between the fulcrum and power point and L22 is a length between the fulcrum and acting point.

11. An apparatus according to claim 10, further comprising a second elastic member which swings and biases said first lever with a biasing force smaller than that of said first elastic member when said shaft moves in the first direction, wherein a pressing force of said second lever, swung and biased by said first elastic member, toward said second support member and a pressing force of said first lever, swung and biased by said second elastic member, toward said first support member are set almost equal to each other.

12. An apparatus according to claim 4, further comprising:

surface pressure adjusting members (75, 76) which are interposed between said first support member and first lever, and between said second support member and second lever, respectively, and each have a semi-elliptic section; and said first and second levers respectively have notches in which said surface pressure adjusting members are to be engaged.

13. An apparatus according to claim 1, further comprising:

a spring bearing member which engages with said first lever, when said shaft moves in the first direction, to swing said first lever; and a second elastic member which biases said spring bearing member in the first direction, wherein when said shaft moves in the first direction, said shaft engages with said second lever and swings said second lever.

14. An apparatus according to claim 13, wherein said shaft has first and second steps which engage with said spring bearing member and said second lever, said first lever has a step which engages with said spring bearing member, said second lever has a step which engages with the second step of said shaft, and said spring bearing member has a bottom surface which engages with the first step of said shaft and the step of said first lever.

15. An apparatus according to claim 14, wherein when said shaft moves in the first direction, the second step of said shaft engages with the step of said second lever to swing said second lever, and the bottom surface of said spring bearing member engages with the step of said first lever to swing said first lever.

16. An apparatus according to claim 15, wherein when said shaft moves in the second direction, the second step of said shaft and the step of said second lever are disengaged from each other, and the first step of said shaft abuts against the bottom surface of said spring bearing member so that said spring bearing member moves in the second direction together with said shaft.

17. An apparatus according to claim 1, wherein said driving means includes an actuator and a working portion which abuts against and separates from one end of said shaft in accordance with operation of said actuator, and when said working portion separates from said shaft, said shaft is moved in the first direction by a biasing force of said first elastic member, and said support mechanism is fixed to said cylinder body by a swing motion of said first and second levers.

* * * * *